US007055220B2

(12) United States Patent
Bertani

(10) Patent No.: US 7,055,220 B2
(45) Date of Patent: Jun. 6, 2006

(54) ADJUSTABLE HANDLE WITH A CONTROL PUSH BUTTON INCORPORATING FAST MOUNTING AND REMOVAL MEANS

(75) Inventor: Alberto Bertani, Milan (IT)

(73) Assignee: ELESA S.p.A., Milan (IT)

( * ) Notice: Subject to any disclaimer, the term of this patent is extended or adjusted under 35 U.S.C. 154(b) by 69 days.

(21) Appl. No.: 10/666,747

(22) Filed: Sep. 18, 2003

(65) Prior Publication Data

US 2004/0068837 A1 Apr. 15, 2004

(51) Int. Cl.
*A47B 95/02* (2006.01)

(52) U.S. Cl. ..... 16/436; 16/438; 16/900; 403/322.1; 403/359.3

(58) Field of Classification Search ..... 16/110.1, 16/436, 438, 900; 403/322.1, 325, 359.1, 403/17, 359.3, 19, 359.4; 74/544, 546–548
See application file for complete search history.

(56) References Cited

U.S. PATENT DOCUMENTS 5,371,919 A * 12/1994 Winkler ..... 16/422
5,533,232 A * 7/1996 Boyer ..... 16/422
5,775,657 A * 7/1998 Hung ..... 248/289.11
5,806,933 A * 9/1998 Tsui et al. ..... 297/391
5,839,388 A * 11/1998 Vadney ..... 114/361
5,879,100 A * 3/1999 Winkler ..... 403/325
5,898,974 A * 5/1999 Boyer ..... 16/114.1
6,101,678 A * 8/2000 Malloy et al. ..... 16/438
6,266,850 B1 * 7/2001 Williams et al. ..... 16/430

* cited by examiner

*Primary Examiner*—Chuck Y. Mah
*Assistant Examiner*—Michael J. Kyle
(74) *Attorney, Agent, or Firm*—Pearne & Gordon LLP

(57) ABSTRACT

Adjustable handle (1), of the type comprising an operating lever (2) ending into a cylindrical or prismatic body (3) inside which there is slidably mounted a tightening member (4) carrying a bushing or a stud (5), the cylindrical or prismatic body (3) and the tightening member (4) comprising fellow toothings (6) kept in reciprocal engagement by a spring (7), and a check element (8) onto which is imparted a pressure to overcome the action of the spring (7) and remove the engagement between said toothings (6). In said handle (1), said check element is in the form of a control push button (8), in one piece with the tightening member (4), said push button (8) incorporating a seat (9) accessible from its operating surface (10) to insert therein a mounting/removal tool.

12 Claims, 1 Drawing Sheet

ADJUSTABLE HANDLE WITH A CONTROL PUSH BUTTON INCORPORATING FAST MOUNTING AND REMOVAL MEANS

The present invention concerns adjustable handles and its object is to introduce improvements therein apt to favour the mounting and removal thereof, while keeping at the top level their ergonomic characteristics as well as their costs and aesthetic features.

The use of adjustable handles has been known for a long time—especially, but not exclusively, in the industrial applications—when requirements arise of repetitive tightening operations, also with a very high frequency, while disposing of limited operating angles. As known, such handles comprise an operating lever ending into a cylindrical or prismatic body, inside which there is slidably mounted a tightening member carrying a bushing or a stud; the cylindrical or prismatic body and the tightening member comprise fellow toothings, kept in reciprocal engagement by a spring and a check element (in the form of a screw or a push button), the pressure imparted on said check element allowing to overcome the action of the spring and remove the engagement between said toothings, so as to interrupt the joint mutual rotation between the handle body and the tightening member, normally guaranteed by said toothings. It is also known that, in such handles, to perform the tightening action one rotates the lever by the small rotation angle available, one lifts said lever with a hand while pressing with the thumb onto the top of the check element and thereby disengaging the toothings of the body and of the tightening member of the handle, one moves back the lever into the idle starting position, one releases the lever thereby automatically causing again the engagement between said toothings, thanks to the action of the spring, one rotates again the lever by the rotation angle available, and so on.

The adjustable handles comprising a check element in the form of a push button projecting from the body have the advantages of being more ergonomic (especially because the smooth surface of the push button—with no unevenness caused by screws and nuts—is apt to provide a comfortable and steady hold for the thumb of the hand operating the handle), of involving less production costs and of guaranteeing insulation from heat and electricity. Furthermore, their push button can easily be produced in different colours, with a remarkable aesthetic effect and with the simultaneous practical advantage of being able to adopt different colours according to the use being made of the handle, or else to adapt such handles to the requirements of the constructors who may wish to associate them to their own trade marks or combine them with the colouring of other parts of the machine on which the handles are mounted. On the other hand, these handles do not allow to use a motored screwer for the mounting thereof, which must always be done manually by acting on the external knurling, with long and uncomfortable operations.

Whereas, the adjustable handles comprising a check element in the form of a screw projecting from the body have, in turn, the advantage of being rapidly and easily mounted by using a motored screwer applied on said screw. On the other hand, they do not enjoy the other advantages provided by the handles with a push button.

Moreover, neither of the two aforedescribed handles allow a fast removal thereof by means of a motored screwer, since this latter cannot be applied on the handles with a push button, nor does it prove to be efficient on the handles with a screw as it could involve the drawback of removing the screw from the handle instead of removing the actual handle.

All the aforementioned drawbacks are brilliantly overcome by the present invention, which concerns an adjustable handle of the type described heretofore, characterized in that it comprises a check element in the form of a control push button in one piece with the tightening member, said push button incorporating a prismatic seat accessible from its operating surface to insert therein a mounting/removal tool.

Preferably, said seat is formed by pressing in said check element, which comprises a cap onto which is formed the operating surface of the control push button and which is applied onto said check element so as to form an integrating part thereof, the spring engaging the fellow toothings of the handle abutting against the periphery of said cap inside the body of the handle.

Suitably, the seat of the operating surface of the control push button may have an hexagonal section, or it may consist of a cross-cut or of a screwdriver cutting, or even of a so-called "torx" seat, while said tool will normally be the Allen wrench or the screwdriver of a motored screwer/unscrewer.

The present invention will now be described in further detail, with reference to the accompanying drawing, in which.

Figure 2:
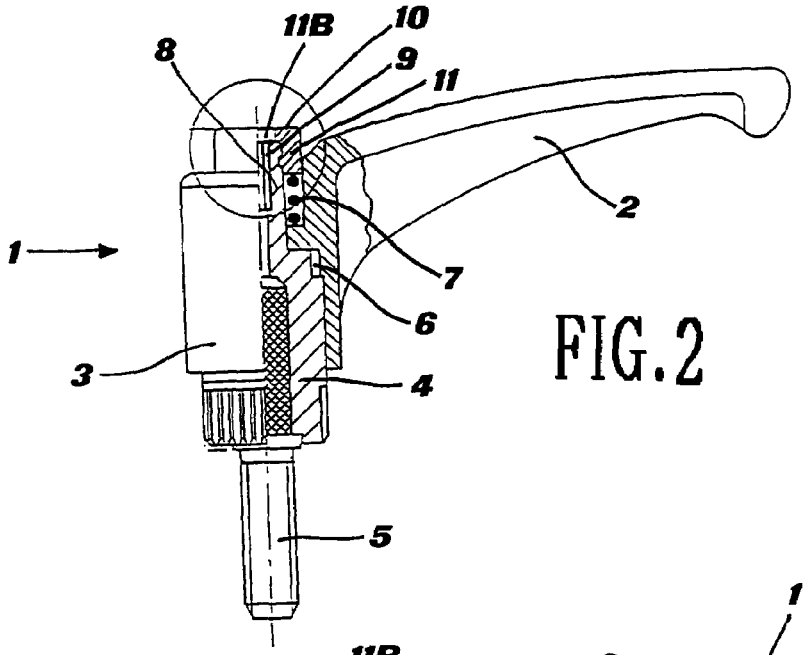
FIG. 2 is a partly sectional side view of the handle illustrated in FIG. 1.
Figure 1:
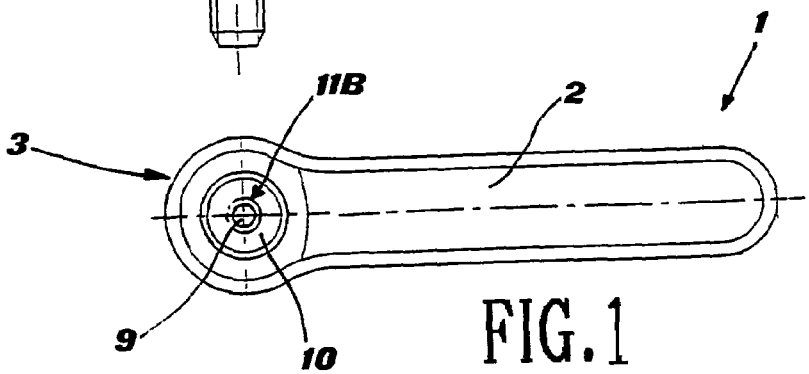
FIG. 1 is a plan view of an adjustable handle according to the present invention.

The adjustable handle 1 according to the invention—shown on the drawings—comprises, in known manner, an operating lever 2 ending into a substantially cylindrical body 3, inside which there is slidably mounted a tightening member 4 carrying a stud 5; the cylindrical body 3 and the tightening member 4 comprise fellow toothings 6, kept in reciprocal engagement by a spring 7 and a check element 8 in the form of a control push button in one piece with the tightening member 4. Also in known manner, the lever 2 has an ergonomic structure, slightly curved and tapered towards the outer end.

Figure 3:
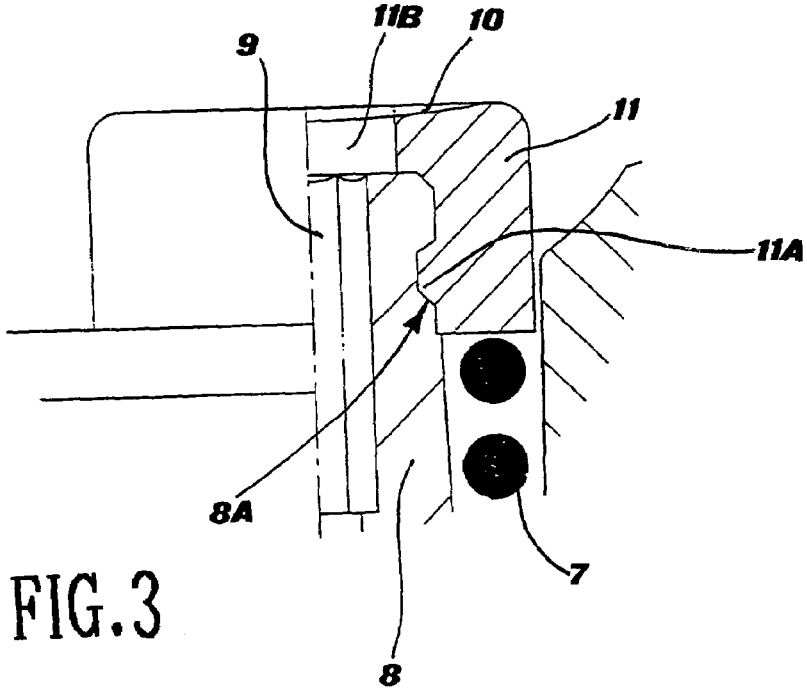
FIG. 3 is an enlargement of the detail of the handle, shown within the circle III of FIG. 1, forming the object of the present invention.

According to the present invention, and as clearly illustrated on the drawings—particularly the enlarged detail of FIG. 3—the control push button forming the check element 8 incorporates a seat 9 accessible from the operating surface 10 of said push button. In the illustrated embodiment of the adjustable handle according to the present invention, said operating surface 10—onto which presses the thumb of the hand operating the handle—is suitably formed onto a cap 11 applied on said check element 8 so as to form an integrating part thereof. Said cap 11 is the visible portion of the control push button 8 of the handle 1. Although other methods can be adopted to apply the cap 11, in the illustrated embodiment of the handle according to the present invention the cap 11 is applied by snapping, thanks to a rib 11A and to a groove 8A of the two components. As can be seen from the drawings—particularly FIG. 3—the spring 7 of the handle 1 engages the check element 8 by abutting against the periphery of the cap 11 inside the body of the handle 1 projecting from said element. As also shown on the drawings, the cap 11 comprises, at the centre of its operating surface 10, a through hole 11B which gives free access into the seat 9 formed in the control push button.

The seat 9—which can be of any shape, but will preferably have an hexagonal section (as shown on the drawing), or which may alternatively consist of a cross-cut or of a screwdriver cutting, or even be a so-called "torx" seat—is formed in such a way that a tool may be comfortably inserted therein, particularly a mounting/removal tool, as the Allen wrench or the screwdriver of a motored screwer/unscrewer, caused to pass through the hole 11B of the cap 11.

The operation of the adjustable handle 1 according to the present invention is fully similar to that of the already known adjustable handles: in fact, by pressing onto the push button 8, in correspondence of the cap 11 which forms its visible portion, one overcomes the action of the spring 7, removing the engagement between the toothings 6, so as to interrupt the joint mutual rotation between the body 3 and the tightening member 4 normally guaranteed by said toothings 6.

Therefore, just as in the known handles, to perform the tightening action with the mounted handle, one rotates the lever 2 of the handle by the small rotation angle available, one lifts said lever 2 with a hand while pressing with the thumb onto the operating surface 10 of the check element 8 in the form of a push button and thereby disengaging the toothings 6 of the body 3 and of the tightening member 4 of the handle 1, one moves back the lever 2 into the idle starting position, one releases said lever 2 thereby automatically causing again the engagement between the toothings 6 thanks to the spring 7, one rotates again the lever 2 by the rotation angle available, one continues the tightening action, and so on (carrying out similar operations, in the opposite sense, for the untightening action).

Nevertheless, unlike the known handles, the adjustable handle according to the present invention can be very quickly and easily mounted and removed, even if disposing of a very limited space, thanks to the seat 9 incorporated in the check element 8 forming part of the the tightening member 4.

Once the stud 5 (or the bushing which can be mounted, in its place, onto the tightening member 4) has been inserted into its seat, it is in fact possible to use for the mounting a motored tool, for example an electric or pneumatic screwer/unscrewer, the operative element of which—preferably an hexagonal Allen wrench, as in the case illustrated on the drawing, or of the "torx" type, or else a star or a simple screwdriver—is inserted into the seat 9 of the check element 8 with cap 11, forming part of the tightening member 4 of the handle 1. The screwing and unscrewing of said handle—namely its mounting and removal—can thus be promptly and easily obtained, even in very narrow spaces, by simply lifting the lever 2 while operating the motored tool.

As compared to the adjustable handles comprising a check element in the form of a push button, according to prior art, the adjustable handle according to the present invention hence provides the important advantage of a fast mounting and removal (which could be previously carried out only by hand, with difficulty and in long times), as well as the known advantages of being more ergonomic (the operating surface 10 of the cap 11 of the control push button 8 is smooth and with no unevenness—see FIG. 3—in spite of the presence of the through hole 11B), of adopting solutions which reduce the production costs, of ensuring insulation from heat and electricity, and of allowing to adopt different colours for the push button according to the use being made of the handles.

But the adjustable handle according to the present invention also provides an advantage in respect of the adjustable handles comprising a check element in the form of a screw projecting from the body: namely the advantage to allow a fast removal which, in most cases, it is impossible or very unlikely to obtain—as already mentioned—also in this type of adjustable handles.

It is anyhow understood that any handles, similar to that described and illustrated in detail heretofore and apt to provide the same benefits, rightfully fall within the protection scope of the present invention as resulting from the following claims.

The invention claimed is:

1. Adjustable handle comprising an operating lever (2) ending into a cylindrical or prismatic body (3) inside which there is slidably mounted a tightening member (4) carrying a bushing or a stud (5), the cylindrical or prismatic body (3) and the tightening member (4) comprising fellow toothings (6) kept in reciprocal engagement by a spring (7), and a check element (8) onto which is imparted a pressure to overcome the action of the spring (7) and remove the engagement between said toothings (6), wherein said check element (8) is a control push button (8) projecting from said body (3), said push button being fixed against rotation in both directions relative to the tightening member (4), said push button (8) incorporating a seat (9) accessible from its operating surface (10) for engagement by a mounting/removal tool.

2. Adjustable handle as in claim 1, wherein said seat (9) is molded into said check element (8).

3. Adjustable handle as in claim 1, wherein said operating surface (10) of the control push button (8) is formed onto a cap (11) which is applied onto said check element (8) so as to form an integrating part thereof, said spring (7) abutting against the periphery of said cap (11) inside the body (3) of the handle (1).

4. Adjustable handle as in claim 3, wherein said cap (11) comprises a through hole (11B) at the center of its operating surface (10) and is applied by snapping onto said check element (8).

5. Adjustable handle as in claim 1, wherein said seat (9) has an hexagonal section.

6. Adjustable handle as in claim 1, wherein said seat (9) is a cross-cut.

7. Adjustable handle as in claim 1, wherein said seat (9) is a screwdriver cutting.

8. Adjustable handle as in claim 1, wherein said tool is an Allen wrench of a motorized screwer/unscrewer.

9. Adjustable handle as in claim 1, wherein said tool is a screwdriver of a motorized screwer/unscrewer.

10. Adjustable handle as in claim 1, wherein said operating lever (2) has an ergonomic structure.

11. Adjustable handle as in claim 10, wherein said operating lever (2) is slightly curved and tapered towards an outer end.

12. Adjustable handle as in claim 1, wherein said mounting/removal tool is motorized.

* * * * *

UNITED STATES PATENT AND TRADEMARK OFFICE

CERTIFICATE OF CORRECTION

PATENT NO. : 7,055,220 B2
APPLICATION NO. : 10/666747
DATED : June 6, 2006
INVENTOR(S) : Alberto Bertani It is certified that error appears in the above-identified patent and that said Letters Patent is hereby corrected as shown below:

On the Title Page:

Item (30) "Foreign Application Prioirity Data" has been omitted.

Please add Item (30) "Foreign Application Priority Data" and insert:
--Sept. 26, 2002 (IT) ..... MI02U000441--

Signed and Sealed this

Twenty-sixth Day of June, 2007

JON W. DUDAS
*Director of the United States Patent and Trademark Office*